US009203166B2

(12) United States Patent
Schumacher

(10) Patent No.: US 9,203,166 B2
(45) Date of Patent: Dec. 1, 2015

(54) ELECTRICAL CABLE CONNECTOR

(71) Applicant: Auto-Kabel Management GmbH, Hausen im Wiesental (DE)

(72) Inventor: Jens Schumacher, Hausen im Wiesental (DE)

(73) Assignee: Auto-Kabel Management GmbH, Hausen i. W. (DE)

( * ) Notice: Subject to any disclaimer, the term of this patent is extended or adjusted under 35 U.S.C. 154(b) by 0 days.

(21) Appl. No.: 14/403,383

(22) PCT Filed: Apr. 17, 2013

(86) PCT No.: PCT/EP2013/058008

§ 371 (c)(1),
(2) Date: Nov. 24, 2014

(87) PCT Pub. No.: WO2013/174582

PCT Pub. Date: Nov. 28, 2013

(65) Prior Publication Data

US 2015/0171525 A1 Jun. 18, 2015

(30) Foreign Application Priority Data

May 25, 2012 (DE) ..... 10 2012 010 279

(51) Int. Cl.

| | |
|---|---|
| ***H01R 4/34*** | (2006.01) |
| ***H01R 11/11*** | (2006.01) |
| ***H01R 13/26*** | (2006.01) |
| *H01R 101/00* | (2006.01) |

(52) U.S. Cl.

CPC ..... *H01R 4/34* (2013.01); *H01R 11/11* (2013.01); *H01R 13/26* (2013.01); *H01R 2101/00* (2013.01)

(58) Field of Classification Search

CPC ..... H01R 4/34; H01R 11/11; H01R 13/26; H01R 2101/00

USPC ..... 439/809, 310

See application file for complete search history.

(56) References Cited

U.S. PATENT DOCUMENTS

| | | | | |
|---|---|---|---|---|
| 4,080,024 | A * | 3/1978 | Kroon | 439/98 |
| 2010/0105233 | A1 | 4/2010 | Butaud | 439/310 |

FOREIGN PATENT DOCUMENTS

| | | |
|---|---|---|
| CH | 66 587 | 9/1914 |
| GB | 175 887 | 3/1922 |

OTHER PUBLICATIONS

International Searching Authority, International Search Report—International Application No. PCT/EP2013/058008, dated Apr. 17, 2013, together with the Written Opinion of the International Searching Authority, 9 pages.

*Primary Examiner* — Javaid Nasri

(74) *Attorney, Agent, or Firm* — Sunstein Kann Murphy & Timbers LLP

(57) ABSTRACT

Electrical connection system, in particular of an underground cable, with a first connecting piece which can be connected to an end of a first cable, wherein a longitudinal axis of the first cable determines a first longitudinal axis, and a second connecting piece which can be connected to an end of a second cable, wherein a longitudinal axis of the second cable determines a second longitudinal axis, wherein the first connecting piece has a seat formed for a protrusion of the second connecting piece, and the second connecting piece has a protrusion corresponding to the seat, and wherein the protrusion can be arranged in the seat to form an electrically conductive connection between the connecting pieces. A particularly simple installation in the region of the underground cables is possible because the seat extends parallel to the first longitudinal axis, the protrusion extends parallel to the second longitudinal axis, and the protrusion can be pushed into the seat parallel to the first longitudinal axis.

20 Claims, 3 Drawing Sheets

ELECTRICAL CABLE CONNECTOR

TECHNICAL FIELD

The subject-matter relates to an electrical connection system, in particular for an underground cable, with two connecting pieces which can be connected together.

BACKGROUND ART

The connection of electrical cables using connecting pieces has been known in the art.

Also, the connection of underground cables is known in itself. Today, the laying of underground cables is preferred in particular in the medium-high voltage range. However, the problem occurs that regularly earthworks are required at the connection point of the cables. Trenches must be excavated and then the cables connected together therein. Since the precise connection point is not known, pits of various lengths must be dug, which makes the laying of underground cables complex and costly.

For this reason, the invention is based on the object of providing an electrical connection system which allows particularly simple laying, in particular in the field of underground cables.

SUMMARY OF THE INVENTION

The connecting pieces have joint faces on the ends facing the respective cables. The cables can be arranged preferably by material fit at the joint faces of the respective connecting pieces. In particular in a preassembled state, the cables can be welded to the joint faces. In particular friction welding methods are suitable for this, as will be explained below. However, resistance welding methods are also suitable for creating the connections between the face ends of the cables and the connecting pieces, or the joint faces of the connecting pieces.

The first connecting piece extends in the direction of a joint face at an end of the first cable. In this extension direction, the first connecting piece constitutes a longitudinal axis.

The second connecting piece extends in the direction of a second joint face at an end of the second cable. In this extension direction, the second connecting piece also forms a longitudinal axis.

The first connecting piece preferably has a seat to receive a protrusion. The protrusion is preferably formed on the second connecting piece. By sliding the protrusion into the seat, it is possible to create an electrically conductive connection between the two connecting pieces and hence between the cables arranged on the connecting pieces.

In particular, friction welding of the connecting piece at a cable end allows a compact connection. The diameter of the connection between the connecting piece and the cable is approximately the same as the cable diameter. The entire connection therefore preferably has the same or a smaller diameter than the cables to be connected or is only slightly larger (e.g. by 10%).

The cable ends can be connected particularly easily using the connection system according to the subject-matter if the seat extends parallel to the first longitudinal axis and the protrusion parallel to the second longitudinal axis. The protrusion can be slid into the seat parallel to the first longitudinal axis (axially to the longitudinal axis) so that the seat and protrusion can be interconnected in the direction of the longitudinal axes. The connecting pieces thus interconnected, with the seat and protrusion, form a large contact area. The contact area formed between the protrusion and the seat is regularly greater than the cross-section area of an individual cable. Thus, the contact resistance between the connecting pieces is minimised.

If the protrusion is then secured in the seat against twisting, a captive connection is guaranteed between the connecting pieces. After insulating the connection system, the cables interconnected in this way can be laid in the underground without having to dig shafts. Horizontal laying by boring or pushing the cables is possible using the connection system according to the subject-matter.

According to one embodiment, it is proposed that the seat is a nut running parallel to the longitudinal axis. A nut preferably has two nut walls and a nut base. The sum of the surface areas of the two nut walls and the nut base is preferably greater than the cross-section area of the cable.

It is also proposed that the protrusion is a web running parallel to the second longitudinal axis. The web preferably corresponds to the nut. In this case, preferably the area of the web walls is also greater than the cross-section area of the cable. The web can be slid into the groove, which is possible by movement of the web parallel to the longitudinal axis of the cable.

A particularly low contact resistance between protrusion and seat is then possible if the cross-section of the protrusion is substantially complementary to the cross-section of the seat. In this case, the protrusion snugs particularly well into the seat. This leads to a large contact area between protrusion and seat, which leads to a low contact resistance.

It is particularly easy to slide the protrusion into the seat if the seat is V-shaped, U-shaped or C-shaped.

The cross-section of the connecting piece, in particular in the region of the protrusion, can then be formed complementary to this.

It is also proposed that the cross-section of the second connecting piece, in particular in the region of the protrusion, is T-shaped or L-shaped. Here, respectively one axis of the connecting piece can serve as a web for the protrusion and engage in the seat. In this case, it is proposed that the seat has a complementary cross-section.

The two interconnected connecting pieces allow a low contact resistance thanks to the large contact area. A mechanical securing of the connecting pieces to each other is required to prevent separation of the protrusion from the seat. In particular, a torque acting on one of the connecting pieces can lead to the protrusion being pressed out of the seat. In order to be able to absorb the forces introduced into the connection point and hence guarantee a secure connection between the protrusion and the seat, it is proposed that in the connected state, the protrusion is fixed in the seat by a securing element.

According to one embodiment, this securing element can penetrate a nut base and be fixed to the protrusion, or penetrate the protrusion and be fixed to the nut base. Depending on the positional relationship between the protrusion and the seat, it may be useful either to push the securing element through the nut base and fix it to the protrusion, or vice versa.

According to one embodiment, it is proposed that the securing element is a screw, in particular a break-off screw or a screw fastened with a defined torque. The use of a break-off screw or a screw fastened with a defined torque is advantageous insofar as this prevents the screw from being tightened with a torque which is so great that the thread shears. However, the use of a torque wrench is also advantageous, since this guarantees that the protrusion is arranged in the seat with a defined tightening torque. It has been found that the seat force between the protrusion and the seat must lie within a defined range in order to create a sufficiently good contact resistance.

It is also proposed that the length of the seat is selected depending on the current conductivity of the connection. In the medium voltage range, different requirements apply to the current conductivity for cables. The connecting area between the seat and the protrusion is selected depending on the current intensity required. The size of the connecting area depends, amongst others, on the length of the seat in which the protrusion is inserted. Preferably, seat and protrusion have approximately the same length.

According to one embodiment, it is proposed that at least one connecting piece has a joint face and that the joint face can be connected to the cable by material fit. The cable or the face end of the cable is welded to the joint face preferably by means of a butt welding process, in particular a friction welding process. The material fit connection minimises the contact resistance between the joint face and the cable. Preferably, the connection between the connecting piece and the cable involves a single material type if these parts are made of metal of the same nature.

When aluminium cables are used, preferably the connecting pieces are also made of aluminium. This has the advantage that no contact resistance or contact corrosion occurs at the transitions between the cables and the connecting pieces.

To prevent the formation of aluminium oxide on the surface of the connecting pieces, it is proposed that the surface of the connecting pieces is tin-plated. It is also possible that the surface is first nickel-plated and then tin-plated. The sublayer of nickel achieves a durable coating, and the tin layer allows a low contact resistance to be achieved.

In order to connect the connecting pieces securely to the cables, it is proposed that a stripped cable end is arranged in a sleeve. In particular, if the connecting pieces are made of copper and the cables of aluminium, a secure connection technique is required. The sleeve can be pressed around the cable ends so that the individual strands or wires of the stripped cable are firmly crimped. Then, the face end of the sleeve is cut or milled so that the cable ends terminate at the face ends of the sleeve and are free from aluminium oxide. Then the connecting piece, which may have one end facing the cable end, is welded to the sleeve and the cable end along the face.

For example, a friction welding process, in particular a rotation friction welding process, can be used here. It is also possible for ultrasonic welding or resistance welding to be used to weld the connecting pieces to the sleeve and the cable ends.

It is also proposed that the sleeve is made of aluminium. Here again, the sleeve may be tin-plated and/or nickel-plated, as described above.

With the use of aluminium cables, a particularly high electrical conductivity is achieved if these have a high purity. In particular, the use of Al 99.5 has proved advantageous. However, the use of aluminium with higher or lower purity is also possible.

It is proposed that the joint face has a diameter which is smaller than or equal to the cable diameter. This guarantees that the connecting piece preferably has a diameter which is smaller than or equal to the diameter of the cable. This is advantageous in particular if the cable is to be laid in the underground and advanced preferably by means of pushing. The connection, which preferably has a diameter corresponding to the cable diameter or maximum 10% larger or smaller, ensures that the connecting point itself can be laid in the underground. Digging of a trench is avoided.

To be able to exert a clamping force on the protrusion and seat in the longitudinal axis, it is proposed that the connecting sleeve is shorter than the stripped end of the cable in order to be arranged on the stripped end of the cable at a distance from a cable insulation. In this case, a space is left between the cable insulation and the connecting sleeve, in which a clamping element can engage. Using this clamping element, it is possible to exert a force in the direction of the connection between the seat and the protrusion.

To secure the connection of the connecting pieces, preferably an insulation sleeve is laid around the connecting pieces. To enable the insulation sleeve to absorb tensile forces in the longitudinal direction, this must be laid against the connecting pieces. For this reason, the connecting pieces according to one exemplary embodiment have a flange running in a plane perpendicular to the longitudinal axis and at least partially surrounding the connecting pieces. Ring shoulders of insulation sleeves can lie on these flanges. The flanges can also be formed by a space left between the connection sleeves and the cable insulation.

The insulation sleeve prevents environmental influences acting on the electrical connection at the connecting pieces. The insulation sleeve can be configured so that it seals the electrical connection at the connecting pieces, so that no moisture can penetrate the electrical connection. For this, it is possible, for example, for the insulation sleeve to lie moisture-tight on the cable insulation in the region of the cable end. This can be achieved, for example, by the use of an O-ring. It is also possible for a shrink hose to be fitted around the insulation sleeve and shrunken onto the cable insulation.

According to one embodiment, it is proposed that an insulation sleeve grips onto the flanges and holds the connecting pieces together in the longitudinal direction.

According to one embodiment, it is proposed that the insulation sleeve is made in two parts, wherein a first part is arranged on the flange of the first connecting piece and a second part on the flange of the second connecting piece, and wherein the parts can be connected together mechanically captively such that in connected state, a force exerted by the parts on the connecting pieces parallel to the longitudinal axis presses the connecting pieces together in the longitudinal axis. This further relieves the tension in the longitudinal direction.

The parts of the insulation sleeve can, for example, be screwed together or formed as a bayonet closure so that one part locks in the other.

To fix the insulation sleeve or parts together, these must preferably be screwed together as described. To facilitate this screw connection, a castle nut is arranged on at least one part to receive a sickle spanner, wherein the first part can be screwed to the second part by means of the castle nut.

BRIEF DESCRIPTION OF THE DRAWINGS

The subject-matter is described below in more detail with reference to drawings showing exemplary embodiments. The drawings show.

DETAILED DESCRIPTION OF SPECIFIC EMBODIMENTS

Figure 1:
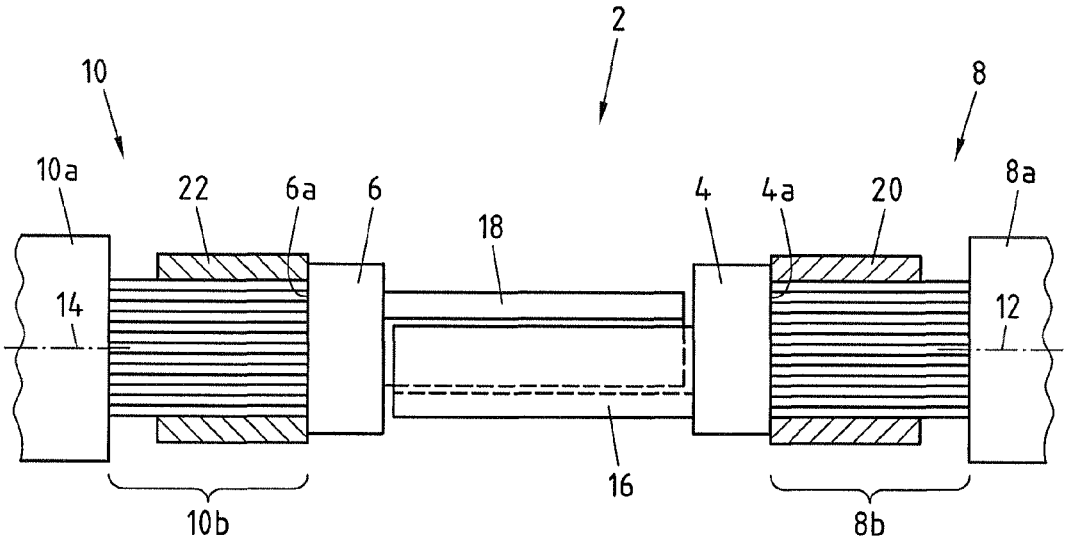
FIG. 1 a side view of a connection system according to the invention.

FIG. 1 shows a connection system 2 with two connecting pieces 4, 6 which are arranged by material fit with joint faces 4*a*, 6*a* on face ends of cables 8, 10.

Figure 2:
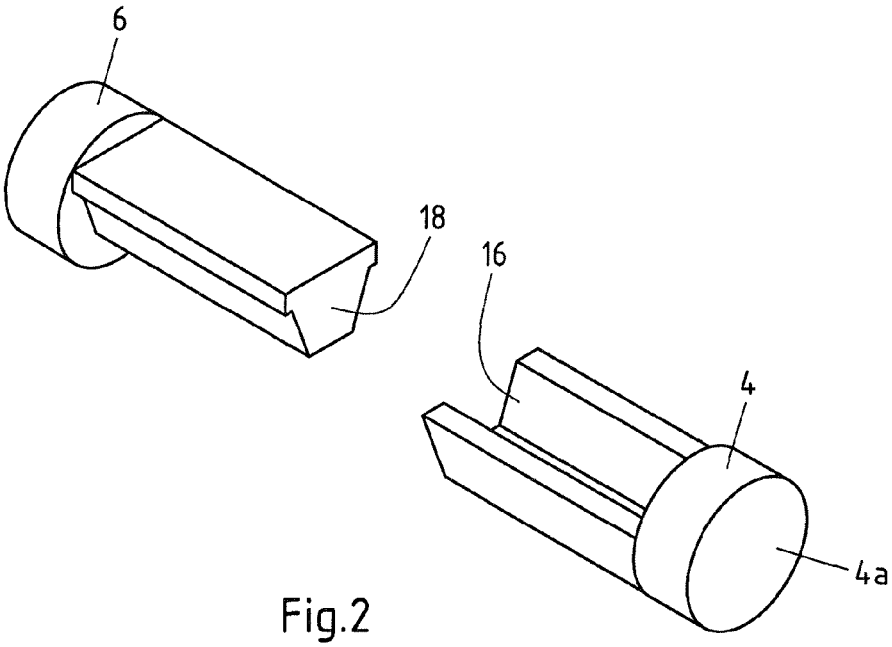
FIG. 2 a view of a seat and a protrusion.

As evident from FIG. 2, the connecting pieces 4, 6 each extend along a longitudinal axis 12, 14 of the respective cable 8, 10. The connecting pieces 4, 6 preferably run parallel to the longitudinal axes 12, 14.

Starting from the joint faces 4*a*, 6*a*, the connecting pieces 4, 6 extend into a seat 16 and a protrusion 18 respectively.

It is furthermore evident that the protrusion 18 is arranged in the seat 16. A conductive connection between the cables 8, 10 or the strands of the cables 8, 10 is guaranteed via the connecting pieces 4, 6 or the contact faces between the protrusion 18 and seat 16.

The strands of the cables 8, 10 are exposed in a stripped region 8*b*, 10*b* of the cable 8, 10. In the region of the face end of the cable, a connecting sleeve 20, 22 is pushed over the strands. The connecting sleeve 20, 22 crimps the strands of the cable 8, 10 such that these can be welded by material fit to the connecting pieces 4, 6 using a butt welding process. Friction welding processes are particularly suitable here. In particular, a rotation friction welding or ultrasonic welding is suitable for making the connection between the connecting piece 4, 6 and the cable 8, 10. Also, resistance welding processes are possible.

As is further evident from FIG. 1, the connecting sleeves 20, 22 extend starting from the face ends of the cables 8, 10 into the region of the stripped ends 8*b*, 10*b*. The connecting sleeves 20, 22 are shorter than the length of the stripped ends 8*b*, 10*b* so that a gap is left between the connecting sleeve 20 and the respective insulation 8*a*, 10*a*. As will be shown below, an insulation sleeve can be inserted in this gap. Together with this gap, the connecting sleeve 20, 22 can form a flange of a connecting piece 4, 6 on which the insulation sleeve engages.

FIG. 2 shows a view of the connecting pieces 4, 6. It is evident that the connecting piece 4 extends into the protrusion 18. In the region of the protrusion 18, the connecting piece 4 has a T-shaped cross-section.

The seat 16 of the connecting piece 6 extends starting from the joint face 4*a* and has a V-shaped cross-section. The seat 16 is formed as a nut, whereas the protrusion 18 is formed as a web. Sliding along the longitudinal axes 12, 14 allows the protrusion 18 to be pressed into the nut 16. The casing surfaces of the protrusion 18 and nut 16 lie against each other so that a low contact resistance is achieved.

The connecting pieces 4, 6 are preferably made of aluminium. The connecting pieces 4, 6 can be subplated in nickel and then tin-plated.

Figure 3:
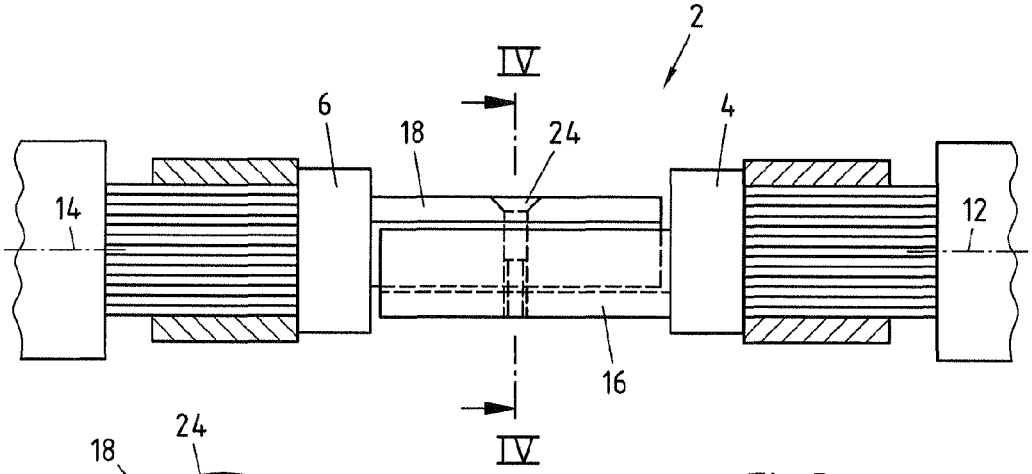
FIG. 3 a further side view of a connection system according to the invention.

The connecting pieces 4, 6 can be fixed together by a securing element, in particular to prevent a movement of the connecting pieces 4, 6 parallel to the longitudinal axes 14, 12. Such a securing element is shown in FIG. 3. FIG. 3 shows that the connection system 2 shown in FIG. 1 is also secured with a screw 24. The screw 24 connects the protrusion 18 to the seat 16. This is illustrated with the section view IV shown in FIG. 3, as evident from FIG. 4.

Figure 4:
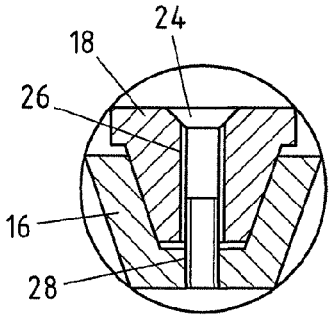
FIG. 4 a cross-section view through a connection system according to FIG. 3.

FIG. 4 shows that the screw 24 is inserted through a through bore 26 in the protrusion 18. A thread 28 is arranged in the nut base of the seat 16. The screw 24 can be screwed into this.

Figure 5:
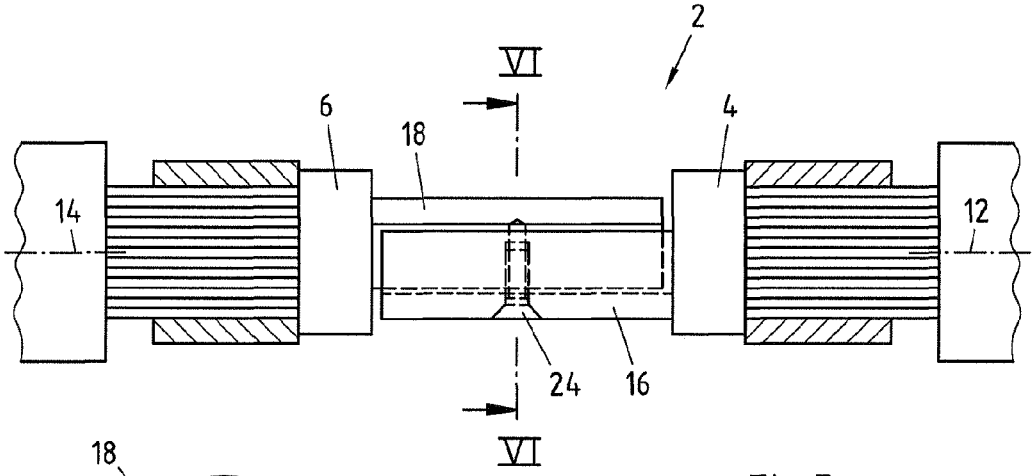
FIG. 5 a side view of a further connection system.

FIG. 5 shows a connection system 2 according to FIG. 1, wherein however the screw 24 is screwed through the seat 16 into the protrusion 18. This is also evident in section IV.

Figure 6:
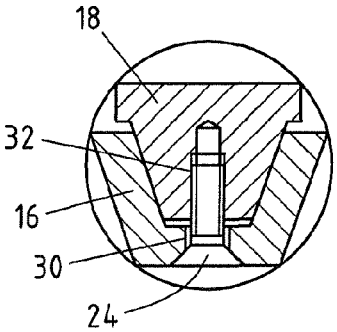
FIG. 6 a cross-section view through a connection system according to FIG. 5.

FIG. 6 shows section VI from FIG. 5. It is clear that the screw 24 is pushed through a through bore 30 and screwed into a thread 32 in the protrusion 18.

The screw 24 prevents the connecting pieces 4, 6 from twisting relative to each other. It also prevents the connecting pieces 4, 6 from moving parallel to the longitudinal axis 12, 14.

The screw 24 is tightened either with a torque wrench to prevent the thread 28, 32 from shearing, or has a break-off head. The break-off head prevents the screw 24 from being tightened with too great a torque. In particular, when aluminium is used for the connecting pieces 4, 6, it must be ensured that the threads 28, 32 do not shear when the screw 24 is tightened. Also, a defined contact force of the protrusion 18 in the seat 16 must be guaranteed in order to achieve a defined contact resistance.

Figure 7:
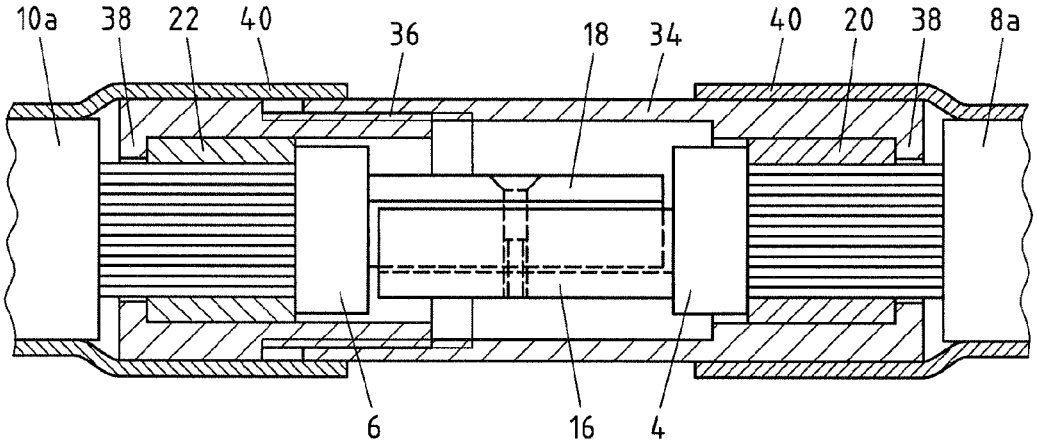
FIG. 7 a side view of a connection system according to the invention with insulation sleeve and shrink hose.

FIG. 7 shows a further embodiment of a connection system 2 according to FIG. 3.

In addition to FIG. 3, an insulation sleeve 34 is provided which is formed of two parts. The two parts of the insulation sleeve 34 can be screwed together via a thread 36. On screwing together, flanges 38 of the insulation sleeve 34 engages behind the respective connecting sleeve 20, 22 in the region of the insulation 8*a*, 10*a* and the connecting sleeves 22, 20. Thus, a force can be exerted in the direction of the connecting pieces 4, 6 so that the connecting pieces 4, 6 can be pressed into each other. This prevents the protrusion 18 from being pressed out of the seat 16.

To prevent the penetration of moisture into the region of the flange 38, a shrink hose 40 is pushed over the respective cable insulation 8*a*, 10*a* and the insulation sleeve 34 and shrunken on.

Figure 8:
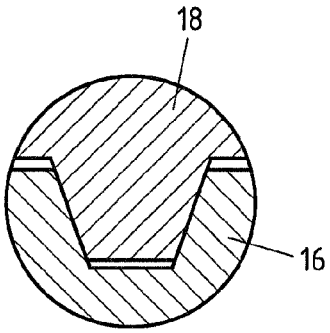
FIG. 8 a cross-section view of a first embodiment of seat and protrusion.

FIG. 8 shows a possible cross-section of the protrusion 18 and seat 16. FIG. 8 shows that the seat is formed V-shaped and the protrusion 18 is T-shaped. Here, the protrusion 18 is, however, formed tapering in the direction of the seat 16.

Figure 9:
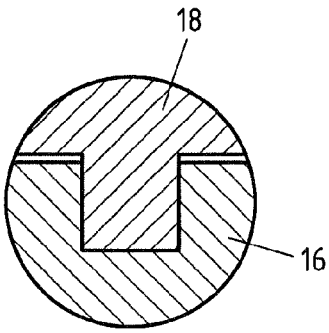
FIG. 9 a cross-section view of a further embodiment of protrusion and seat.

FIG. 9 shows a further possible cross-section in which the protrusion 18 is T-shaped and the seat 16 is I-shaped. It is evident from FIG. 9 that the outer periphery of the protrusion 18 and the seat 16 are formed arcuate, in particular with a radius which is smaller than or approximately equal to the radius of the respective cable 8, 10.

Figure 10:
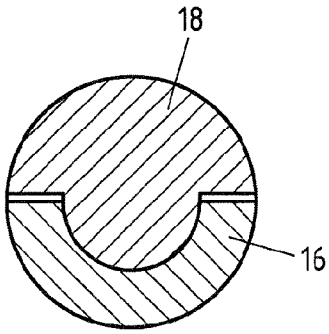
FIG. 10 a cross-section view of a further embodiment of protrusion and seat.

FIG. 10 shows a further embodiment in which the protrusion 18 and seat 16 are each formed semicircular, complementary to each other.

Using the connection system shown, it is possible in particular to lay underground cables while avoiding earth movements. In particular, it is not necessary to dig pits for connecting cables and then have to perform manual connection. Rather, it is possible to connect the cables together in advance and then slide these in the shafts or drive them directly through the ground.

What is claimed is:

1. Electrical connection system, in particular of an underground cable, comprising:

a first conductive connecting piece which can be connected to an end of a first cable, wherein a longitudinal axis of the first cable determines a first longitudinal axis, and a second conductive connecting piece which can be connected to an end of a second cable, wherein a longitudinal axis of the second cable determines a second longitudinal axis, wherein the first conductive connecting piece has a seat formed for a protrusion of the second connecting piece, and the second conductive connecting piece has the protrusion corresponding to the seat, and the seat extends parallel to the first longitudinal axis, the protrusion extends parallel to the second longitudinal axis, and the protrusion is slidably arranged in the seat parallel to the first longitudinal axis, wherein the protrusion is formed to be arranged in the seat for providing an electrically conductive connection between the first and second conductive connection piece, and wherein the protrusion is formed as a web and the seat is formed as a nut and a conductive connection between the first and second cable is formed by contact between the protrusion and the seat, the contact arising between a surface of the protrusion of the second conductive connecting piece and a surface of the seat of the first conductive connecting piece.

2. Electrical connection system of claim 1, wherein the cross-section of the protrusion is substantially congruent to the cross-section of the nut.

3. Electrical connection system of claim 1, wherein the nut is V-shaped or U-shaped or C-shaped.

4. Electrical connection system of claim 1, wherein the cross-section of the second conductive connecting piece is T-shaped or L-shaped.

5. Electrical connection system of claim 1, wherein in the connected state, the protrusion is fixed in the nut by a securing element.

6. Electrical connection system of claim 5, wherein the securing element penetrates a nut base and is fixed to the protrusion, or the securing element goes through the protrusion and is fixed to the nut base.

7. Electrical connection system of claim 5, wherein the securing element is a break-off screw or a screw fastened with a defined torque.

8. Electrical connection system of claim 1, wherein the length of the nut is selected depending on the current conductivity of the connection.

9. Electrical connection system of claim 1, wherein at least one connecting piece has a joint face and the joint face can be connected to the cable by material fit.

10. Electrical connection system of claim 9, wherein the joint face has a diameter which is smaller than or equal to the cable diameter.

11. Electrical connection system of claim 1, wherein a cable end is stripped of cable insulation, a connecting sleeve is arranged over the stripped cable end, the connecting sleeve compresses the cable in the region of the stripped end, and a joint face is connected to the face end of the cable by material fit.

12. Electrical connection system of claim 11, wherein the joint face has a diameter which is smaller than or equal to the cable diameter.

13. Electrical connection system of claim 11, wherein the connecting sleeve is shorter than the stripped end of the cable and is arranged on the stripped end of the cable at a distance from the cable insulation.

14. Electrical connection system of claim 11, wherein the connecting sleeve is made of aluminium, copper or alloys thereof, and/or the cables are made of aluminium, copper or alloys thereof.

15. Electrical connection system of claim 11, wherein the connecting sleeves are metal-coated, in particular subplated in nickel and/or tin-plated.

16. Electrical connection system of claim 11, wherein the conductive connecting pieces are surrounded by an insulating housing and wherein the insulating housing is arranged on the connecting sleeve, in particular in the region between the connecting sleeve and the cable insulation, such that the tensile forces acting in the direction of the longitudinal axis can be absorbed by the housing.

17. Electrical connection system of claim 1, wherein the conductive connecting pieces are made of aluminium or alloys thereof.

18. Electrical connection system of claim 1, wherein the conductive connecting pieces are metal-coated, in particular subplated in nickel and/or tin-plated.

19. Electrical connection system of claim 1, wherein the conductive connecting pieces are surrounded by an insulating housing.

20. Electrical connection system of claim 19, wherein the insulating housing is arranged on flanges of the conductive connecting pieces facing the respective cables, such that the tensile forces acting in the direction of the longitudinal axis can be absorbed by the housing.

* * * * *